US009820028B2

(12) United States Patent
Long

(10) Patent No.: US 9,820,028 B2
(45) Date of Patent: Nov. 14, 2017

(54) CORD MANAGEMENT DEVICE

(71) Applicant: Robert J. Long, Newton, MA (US)

(72) Inventor: Robert J. Long, Newton, MA (US)

(73) Assignee: Robert J. Long, Stillwater, NY (US)

( * ) Notice: Subject to any disclaimer, the term of this patent is extended or adjusted under 35 U.S.C. 154(b) by 237 days.

(21) Appl. No.: 14/664,516

(22) Filed: Mar. 20, 2015

(65) Prior Publication Data

US 2016/0010672 A1 Jan. 14, 2016

Related U.S. Application Data

(60) Provisional application No. 61/968,895, filed on Mar. 21, 2014.

(51) Int. Cl.
*A44B 1/04* (2006.01)
*H04R 1/10* (2006.01)

(52) U.S. Cl.
CPC ..... *H04R 1/1033* (2013.01)

(58) Field of Classification Search
CPC .... H04R 1/1033; H04R 1/1016; H04R 5/033; H04R 2460/17
See application file for complete search history.

(56) References Cited

U.S. PATENT DOCUMENTS 4,942,617 A 7/1990 Boylan
5,832,098 A 11/1998 Chen
6,434,249 B1 8/2002 Wei
6,480,611 B2 11/2002 Hashimoto
6,616,080 B1 9/2003 Edwards
6,658,130 B2 12/2003 Huang
6,912,291 B2 6/2005 Huang
7,032,728 B2 4/2006 Harcourt
7,184,565 B2 2/2007 Ohta
7,297,001 B2 11/2007 Wu
7,372,974 B2 5/2008 Yanagishita
7,436,974 B2 * 10/2008 Harper ..... H04R 1/1033 381/374
7,492,917 B2 2/2009 Ito
7,512,417 B2 3/2009 Cheng
7,599,509 B2 10/2009 Ito
7,610,661 B2 11/2009 Sween
7,614,578 B2 11/2009 Ito
7,664,540 B2 2/2010 Tsai
7,995,783 B2 * 8/2011 Ledbetter ..... H04R 1/1016 381/374
8,121,304 B2 2/2012 Bales
8,139,809 B2 3/2012 Jubelirer
8,147,270 B1 4/2012 Wescott
8,165,332 B2 4/2012 Giese
(Continued)

FOREIGN PATENT DOCUMENTS

WO WO 2014090538 A1 * 6/2014 ..... H04R 1/1033

*Primary Examiner* — Victor Batson
*Assistant Examiner* — Matthew J Sullivan
(74) *Attorney, Agent, or Firm* — Jessica Ergmann

(57) ABSTRACT

Systems, devices and methods for managing a cord, for example a headphone cord includes a first connector configured to connect to a second connector, creating a connection point such that the cord can be wrapped around the connection point. A third connector can also be included configured to attach a cord portion or a plug to a different cord portion when the cord is wrapped around the connection point.

18 Claims, 6 Drawing Sheets

(56) References Cited

U.S. PATENT DOCUMENTS

| | | | | |
|---|---|---|---|---|
| 8,186,642 | B2 | 5/2012 | Weiss-Vons | |
| 8,229,154 | B2 | 7/2012 | Ito | |
| 8,249,286 | B2 * | 8/2012 | Nault | H04R 1/1033 381/182 |
| 8,261,416 | B2 | 9/2012 | Rothbaum | |
| 8,265,325 | B2 | 9/2012 | Park | |
| 8,284,981 | B2 | 10/2012 | Cataldo | |
| 8,290,193 | B2 | 10/2012 | Pang | |
| 8,345,913 | B2 | 1/2013 | Pang | |
| 8,605,933 | B2 * | 12/2013 | Massey | H04R 1/1033 381/370 |
| 8,714,358 | B2 | 5/2014 | Debitzky | |
| 8,740,124 | B2 | 6/2014 | Cheng | |
| 2002/0023814 | A1 | 2/2002 | Poutiatine | |
| 2005/0175210 | A1 | 8/2005 | Yang | |
| 2005/0220319 | A1 | 10/2005 | Chan | |
| 2008/0170740 | A1 * | 7/2008 | Gantz | H04R 1/1058 381/380 |
| 2008/0310666 | A1 * | 12/2008 | Wengreen | H04R 1/026 381/381 |
| 2011/0317865 | A1 | 12/2011 | Stevinson | |
| 2012/0006581 | A1 * | 1/2012 | Cross | H01R 13/60 174/135 |
| 2012/0163647 | A1 | 6/2012 | Chang | |
| 2012/0314896 | A1 | 12/2012 | Bryant | |
| 2015/0365755 | A1 * | 12/2015 | Harper | H04R 1/1033 381/384 |
| 2016/0269818 | A1 * | 9/2016 | MacKay | H04R 1/1033 |

* cited by examiner 300
310
320

300
310
320

300
310
320

CORD MANAGEMENT DEVICE

FIELD OF THE INVENTION

The present invention relates generally to systems, devices and methods, for managing cords, and more specifically to systems, devices, and methods for managing headphone cords.

BACKGROUND OF THE INVENTION

In using and storing electronic devices having cords, it is common to experience cord tangling. For example, when a user is not wearing headphones, cord ends are unrestrained and free to move in any direction. While the headphones are stored, for instance, lying on a desk, in a drawer, or in a bag, to name a few, the free ends inevitably become intertwined and tangle. Once tangling occurs, a person is required to spend needless time and effort attempting to untangle the various ends. Moreover, once a person successfully untangles the headphone cords, there is nothing to prevent the cord ends from tangling yet again in the future. In addition, the tangling can result in knots, thereby creating kinks in the wires inside the cords and potentially damaging the operation of the headphones.

Therefore, it is desirable to provide systems, devices, and methods to reduce cord tangling.

SUMMARY

According to an aspect of the invention, a headphone cord management device comprises a first connector comprising a first tubular member and a first connecting member and a second connector comprising a second tubular member and a second connecting member, where the first connector is configured to connect to the second connector. The device can further comprise a third connector comprising a first opening and a second opening, where the first opening can be configured to connect to a distal end of a cord or a plug, and the second opening can be configured to connect to a portion of the cord.

According to another aspect of the invention, a headphone cord management device comprises a first connector comprising a first tubular member and a first connecting member; a second connector comprising a second tubular member and a second connecting member; and a third connector comprising a first opening and a second opening, where the first connector is configured to connect to the second connector, and where the first opening is configured to connect to a distal end of a cord or a plug, and the second opening is configured to connect to a portion of the cord.

According to another aspect of the invention, a headphone cord management device comprises a means for housing a portion of a first cord portion; a means for housing a portion of a second cord portion; a means to connect the housed cord portions; and a means to connect a distal end of a cord or a plug to a portion of the cord.

According to another aspect of the invention, a system comprises headphones comprising: a first earpiece; a second earpiece; a cord having a first cord portion, a second cord portion, and a third cord portion; and a plug positioned on a distal end of the third cord portion; and a cord management device comprising: a first connector comprising a first connecting member and a first tubular member having a lumen configured to house a portion of the first cord portion; a second connector comprising a second connecting member and a second tubular member having a lumen configured to house a portion of the second cord portion; and a third connector comprising a first opening and a second opening, where the first connector is configured to connect to the second connector, and where the first opening is configured to connect to a distal end of the cord or the plug and the second opening is configured to connect to a portion of the cord.

According to another aspect of the invention, a system comprises headphones comprising: a first earpiece; a second earpiece; a cord having a first cord portion, a second cord portion, and a third cord portion; and a plug positioned on the distal end of the third cord portion; and a cord management device comprising: a means for housing a portion of the first cord portion; a means for housing a portion of the second cord portion; a means to connect the housed cord portions; and a means to connect a distal end of the cord or the plug to a portion of the cord.

According to another aspect of the invention, a cord management device comprises a connector comprising a first opening and a second opening, where the first opening is configured to connect to a distal end of a cord or a plug, and the second opening is configured to connect to a portion of the cord.

According to another aspect of the invention, a method for using a cord management device comprises inserting a first portion of a cord into a first tubular member having a first lumen; inserting a second portion of the cord into a second tubular member having a second lumen; connecting a first connector and a second connector forming a connection point; wrapping the cord around the connection point; connecting a third connector to a distal end of the cord or a plug; and connecting the third connector to a portion of the cord.

According to any of the above aspects of the invention, the device can comprise one or more of a plastic such as a sophisticated plastic or a thermosetting plastic, a polymer, a wood, or a metal. Examples include but are not limited to: polyester, polycarbonate, polyethylene terephthalate, high density polyethylene, polyvinyl chloride, low density polyethylene, polypropylene, polystyrene, rubber, silicone, vinyl, or polytetrafluoroethylene.

According to any of the above aspects of the invention, the first, second and/or third connectors can be integral to a pair of headphones. Alternatively, the first, second and/or third connectors can be used with a pair of off-the-shelf headphones. The first and second connectors can create a relatively "H" shape or relatively "X" shape when connected. The first and/or second connector can further comprise a support configured to receive a headphone earpiece, for example, the support can be secured to the earpiece.

According to any of the above aspects of the invention, the first tubular member can be configured to house a portion of a first cord portion, and the second tubular member can be configured to house a portion of a second cord portion. The first and/or second tubular member can comprise a length ranging from 10 mm to 60 mm. The first and/or second tubular members can comprise an outer diameter ranging from 1 mm to 10 mm. The first and/or second tubular member can comprise an inner diameter ranging from 0.25 mm to 8 mm. The first and/or second tubular member can comprise a thickness ranging from 0.25 mm to 4 mm. The first and/or second tubular member can comprise a bowed configuration. The first and/or second tubular member can comprise a relatively straight configuration from a proximal end to a distal end. The first and/or second tubular member can comprise at least one of a circular, an elliptical, a triangular, a rectangular, or a square cross sectional shape. The first and/or second tubular member can comprise a slit from a proximal end to a distal end. The first and/or second tubular member can comprise a two-piece configuration where a first piece connects to a second piece. The first and/or second tubular member can comprise a hinged design. The first tubular member can comprise a first lumen, and the second tubular member can comprise a second lumen. The first and/or second lumen can comprise a relatively constant diameter from a proximal end to a distal end. The first and/or second lumen can comprise a diameter that is larger at a proximal portion as compared to a distal portion.

According to any of the above aspects of the invention, the first and/or second connecting member can be integral to a respective first and/or second tubular member. The first connecting member can be configured to connect to the second connecting member via a mechanical connection. For example, the mechanical connection can be at least one of a male/female connector; a hook and loop; a screw; a tongue and groove; a pin and hole; or a snap-fit. The first connecting member can be configured to provide a tactile and/or an audible feedback upon connection to the second connecting member. The first connecting member can comprise a protrusion, and the second connecting member can comprise a groove, where the protrusion can be configured to slide into the groove. The first connecting member can be configured to connect to the second connecting member via a magnetic connection. The first connecting member can be configured to connect to the second connecting member at a connection point, and a cord can be configured to wrap around the connection point. The first connector can comprise a first surface, and the second connector can comprise a second surface, where the first surface and the second surface are configured to increase the surface area of the connection point.

According to any of the above aspects of the invention, the third connector can comprise a first opening and a second opening. The first opening can be configured to connect to a distal end of a cord or a plug, and the second opening can be configured to connect to a portion of the cord. The first opening can be approximately 180 degrees from the second opening. The third connector can comprise at least one of a circular, an elliptical, a triangular, a rectangular, or a square cross sectional shape.

The technology described herein, along with the attributes and attendant advantages thereof, will best be appreciated and understood in view of the following detailed description taken in conjunction with the accompanying drawings in which representative embodiments are described by way of example.

DETAILED DESCRIPTION OF THE DRAWINGS

Figure 1:
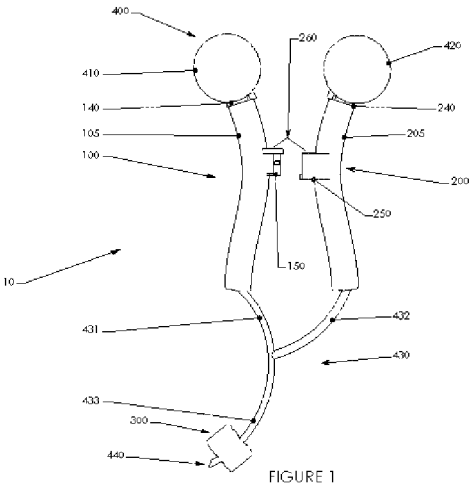
FIG. 1 is a schematic of a system for managing headphone cords, with a pair of headphones in an unwrapped configuration, consistent with the present invention.

Reference will now be made in detail to the present embodiments of the technology, examples of which are illustrated in the accompanying drawings. The same reference numbers are used throughout the drawings to refer to the same or like parts.

The terminology used herein is for the purpose of describing particular embodiments and is not intended to be limiting of the inventive concepts. As used herein, the singular forms "a," "an" and "the" are intended to include the plural forms as well, unless the context clearly indicates otherwise.

It will be further understood that the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") when used herein, specify the presence of stated features, integers, steps, operations, elements, and/or components, but do not preclude the presence or addition of one or more other features, integers, steps, operations, elements, components, and/or groups thereof.

It will be understood that, although the terms first, second, third etc. may be used herein to describe various limitations, elements, components, regions, layers and/or sections, these limitations, elements, components, regions, layers and/or sections should not be limited by these terms. These terms are only used to distinguish one limitation, element, component, region, layer or section from another limitation, element, component, region, layer or section. Thus, a first limitation, element, component, region, layer or section discussed below could be termed a second limitation, element, component, region, layer or section without departing from the teachings of the present application.

It will be further understood that when an element is referred to as being "on", "attached", "connected" or "coupled" to another element, it can be directly on or above, or connected or coupled to, the other element or intervening elements can be present. In contrast, when an element is referred to as being "directly on", "directly attached", "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

Spatially relative terms, such as "beneath," "below." "lower," "above," "upper" and the like may be used to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in a figure is turned over, elements described as "below" and/or "beneath" other elements or features would then be oriented "above" the other elements or features. The device can be otherwise oriented (e.g., rotated 90 degrees or at other orientations) and the spatially relative descriptors used herein interpreted accordingly.

The term "and/or" where used herein is to be taken as specific disclosure of each of the two specified features or components with or without the other. For example "A and/or B" is to be taken as specific disclosure of each of (i) A, (ii) B and (iii) A and B, just as if each is set out individually herein.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination. For example, it will be appreciated that all features set out in any of the claims (whether independent or dependent) can be combined in any given way.

As used herein, a cord can include a wire, string, cable and the like. Some cords have one beginning and one end. One example of such a cord is an electric appliance cord that can be removed from the appliance. One end has a plug for insertion into an electric mains and the other end is inserted into a jack (either female or male) on the appliance. Other applications involve cords with more than one beginning and one end. Various telephone cords, for example, split after a certain length to connect two or more telephones to a telephone jack in the wall. Similarly, a number of television cords, whether using cable or satellite, split at certain points in order to transfer data to multiple television sets or to send signals to different channels, such as the L and R speaker channels. Another example is a cord used for electronic headphones. Such headphone cords extend from an electronic device to a listener's ears, allowing the listener to hear audio, for example cassette players, CD/DVD players, or any device configured to play audio/video files. A user can insert a male plug end of the headphone cord into a corresponding female socket of the electronic device. After a certain length, the headphone cord splits into two separate cords, resulting in a "Y" configuration. These two ends are fitted with earpieces that fit into, over and/or around a person's left and right ears. One example is the common ear-bud configuration. On some models, the earpiece orientation is ear specific, whereas, in other models, the earpieces are interchangeable between the user's left and right ears. The embodiments described herein can be used with any of these devices and/or cords.

FIG. 1 is a system for managing headphone cords, with a pair of headphones in an unwrapped configuration. The system includes headphones 400 and cord management device 10. Headphones 400 comprise first earpiece 410, second earpiece 420, cord 430, and plug 440, e.g. input to an electronic device, positioned at the distal end of cord 430. Cord 430 comprises third cord portion 433, and cord 430 splits into first cord portion 431 and second cord portion 432, resulting in a "Y" configuration. Cord management device 10 comprises first connector 100 and second connector 200. First connector 100 comprises first tubular member 105 having a lumen configured to house a portion of first cord portion 431, and similarly, second connector 200 comprises second tubular member 205 having a lumen configured to house a portion of second cord portion 432. First connector 100 is configured to connect to second connector 200 via first and second connecting members 150, 250 creating connection point 260.

Figures 5A, 5B, 5C:
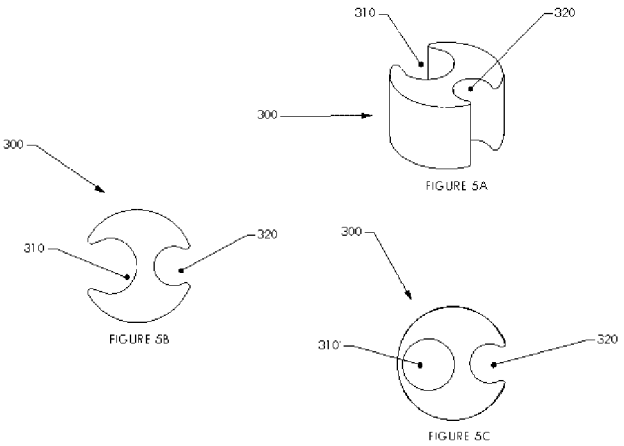
FIG. 5A is a side view of an exemplary third connector.
FIG. 5B is a top view of the connector of FIG. 5A.
FIG. 5C is a top view of an alternate third connector; consistent with the present invention.

Cord management device 10 can further comprise third connector 300 comprising a first opening configured to connect to a distal end of cord 430, for example third cord portion 433, or plug 440 and a second opening configured to connect to a portion of cord 430, openings shown in FIG. 5A-C herein.

Connectors 100, 200 can comprise first and second earpiece supports 140, 240 configured to receive earpieces 410, 420, respectively. Earpiece supports 140, 240 can extend from the proximal end of tubular members 105, 205 and can comprise a concave shape such that at least a portion of earpieces 410, 420 rest in earpiece supports 140, 240. Earpiece supports 140, 240 can be configured and sized to accommodate various style earpieces 410, 420, for example, in-ear earbud style (as shown) or over-the-ear style earpieces. In some embodiments, earpiece supports are excluded from device 10.

Figure 2:
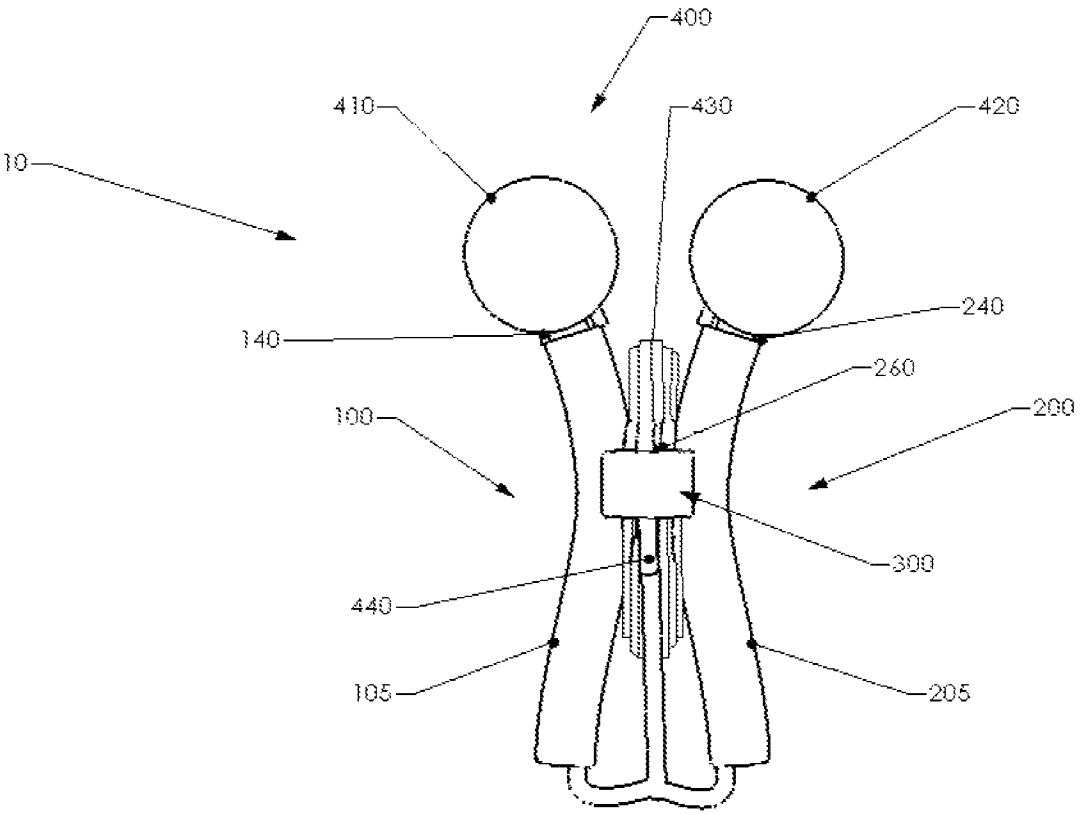
FIG. 2 is a schematic of the system of FIG. 1, with the headphones in a wrapped configuration, consistent with the present invention.
Figure 6:
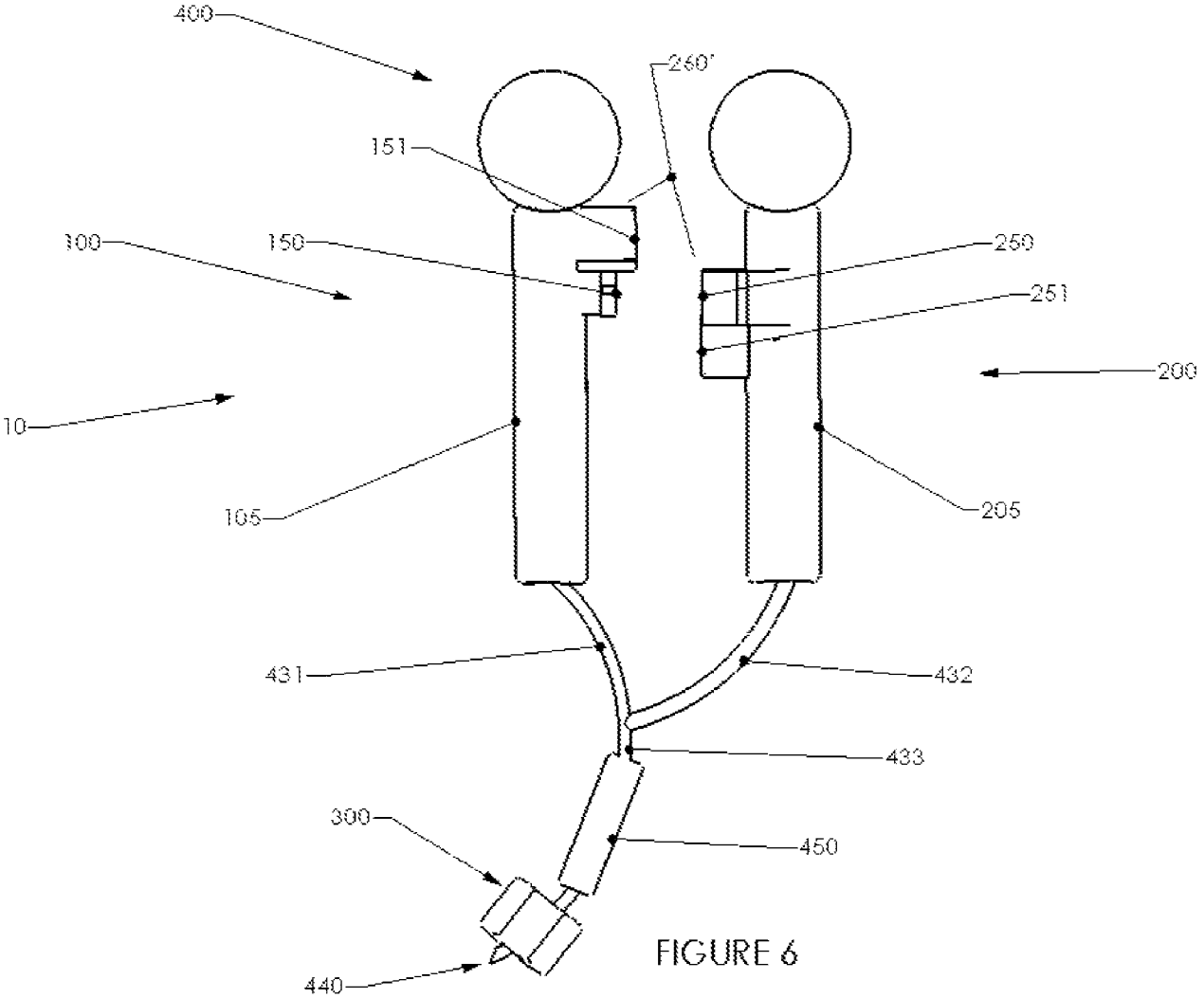
FIG. 6 is a schematic of a system for managing headphone cords, with a pair of headphones in an unwrapped configuration, consistent with the present invention.

FIG. 2 is the system of FIG. 1, with headphones in a wrapped configuration. When headphones 400 are not in use, a user can connect first connector 100 to second connector 200 such that first connecting member 150 creates connection point 260 with second connecting member 250. When connected, first and second connectors 100, 200 create a relatively "H" shaped configuration, enabling the user to wrap cord 430 around connection point 260, and connect third connector 300 to any portion of cord 430 such that cord 430 remains in a wrapped configuration. In some embodiments, tubular members 105, 205 can comprise a bowed configuration such that the distance between the distal end and proximal end portions of each connector 100, 200 is greater than at the midportions of each connector 100, 200 when connected, for example first and second connectors 100, 200 create a relatively "X" shaped configuration. This bowed configuration can provide ample space for cord 430 to be wrapped around connection point 260. In other embodiments, not shown, tubular members 105, 205 can comprise a bowed configuration on one of the distal end or the proximal end. In some embodiments, tubular members 105, 205 can comprise a relatively straight configuration from the distal end to the proximal end, for example as shown in FIG. 6. The configuration of tubular members, e.g. bowed, partially bowed, or straight, can be selected to accommodate various headphones.

When headphones 400 are in use, third connector 300 can be disconnected from cord 430, e.g. remove the portion of cord 430 from the second opening such as second opening 320 shown in FIG. 5C herein, and connecting members 150, 250 can be disconnected so that the user can place earpieces 410, 420 in each ear. If the user desires to use one earpiece 410 or 420, connecting member 150 can be connected to connecting member 250 such that the unused earpiece 410 or 420 does not dangle and become tangled or get in the user's way. Third connector 300 can remain connected to a distal end of cord 430 or plug 440 via the first opening such as first opening 310 shown in FIG. 5B or 310' shown in FIG. 5C herein.

In the embodiments of FIGS. 1 and 2, cord management device 10 is integral to headphones 400, i.e., headphones 400 are manufactured with cord management device 10 built-in. For example headphones 400 can be custom molded, and cord management device 10 can be configured to headphones 400. However, cord management device 10 can be used with off-the-shelf headphones. In these embodiments, first and second tubular members 105, 205 can each comprise a slit such that a user can insert cord portions 431, 432 into tubular members 105, 205, for example slits 120, 220 shown in FIGS. 3B and 4B herein. Also in these embodiments, third connector 300 can comprise a first opening configured to connect to, e.g. partially enclose a distal end of cord 430 or plug 440, and a second opening configured to connect to, e.g. partially enclose a portion of cord 430 such that a user can insert portions of cord 430 and/or plug 440 into both openings, openings shown in FIGS. 5A and 5B herein. Cord management device 10 can be configured for any off-the-shelf headphones.

Any component of cord management device 10, including connectors 100, 200, 300 and any component thereof can comprise one or more materials including but not limited to a plastic, for example a sophisticated plastic or a thermosetting plastic, a polymer, a wood, a metal, and the like. Examples include but are not limited to polyester, polycarbonate, polyethylene terephthalate, high density polyethylene, polyvinyl chloride, low density polyethylene, polypropylene, polystyrene, rubber, silicone, vinyl, and polytetrafluoroethylene. The components of cord management device 10, including connectors 100, 200, 300 and any component thereof can comprise similar or different materials in a single device 10.

Figures 3A, 3B, 3C, 3D:
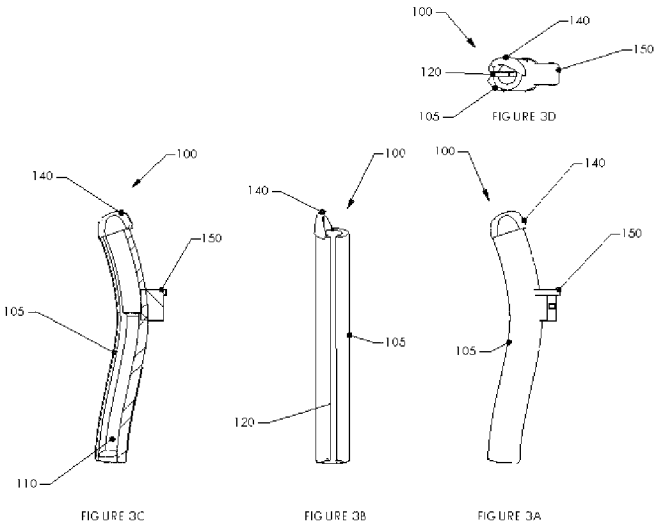
FIG. 3A is a front view of an exemplary first connector.
FIG. 3B is a side view of the connector of FIG. 3A.
FIG. 3C is a cross-sectional view of the connector of FIG. 3A.
FIG. 3D is a top view of the connector of FIG. 3A; consistent with the present invention.
Figure 4D:
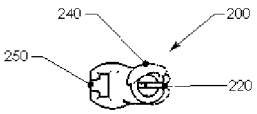
FIG. 4D is a top view of the connector of FIG. 4A; consistent with the present invention.
Figure 4A:
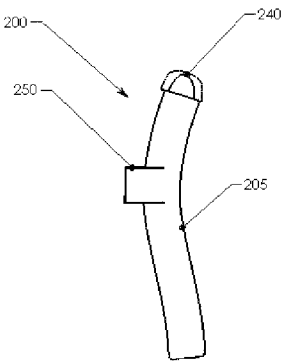
FIG. 4A is a front view of an exemplary second connector.
Figure 4B:
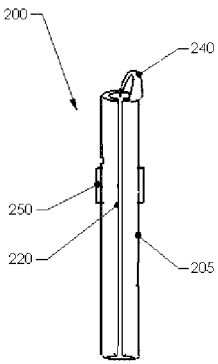
FIG. 4B is a side view of the connector of FIG. 4A.
Figure 4C:
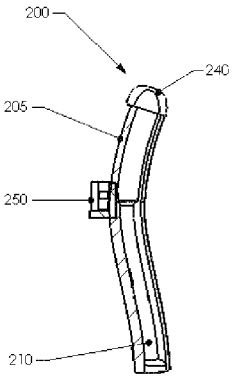
FIG. 4C is a cross-sectional view of the connector of FIG. 4A.

FIG. 3A is a front view of a first connector; FIG. 3B is a side view of the connector of FIG. 3A; FIG. 3C is a cross-sectional view of the connector of FIG. 3A; and FIG. 3D is a top view of the connector of FIG. 3A. FIG. 4A is a front view of a second connector; FIG. 4B is a side view of the connector of FIG. 4A; FIG. 4C is a cross-sectional view of the connector of FIG. 4A; and FIG. 4D is a top view of the connector of FIG. 4A. First connector 100 comprises first tubular member 105 having first lumen 110 and first connecting member 150. Second connector 200 comprises second tubular member 200 having second lumen 210 and second connecting member 250. First tubular member 105 can be configured to house a portion of first cord portion 431 in first lumen 110, and similarly second tubular member 205 can be configured to house a portion of second cord portion 432 in second lumen 210.

Tubular members 105, 205 can comprise any cross-sectional shape, including but not limited to circular, elliptical, triangular, rectangular, or square. Tubular members 105, 205 can comprise a length ranging from approximately 10 mm to 60 mm, for example approximately 38 mm. The length of tubular members 105, 205 can be sized to provide adequate support and space for cord 430 when headphones 400, either integral headphones or off-the-shelf headphones, are in a wrapped configuration. Tubular members 105, 205 can comprise an outer diameter ranging from approximately 1 mm to 10 mm, for example approximately 4 mm. Tubular members 105, 205 can comprise a thickness ranging from approximately 0.25 mm to 4 mm, for example approximately 1 mm. Any dimensions provided herein are exemplary only, and should not be construed as limiting. For example, cord management device 10 can be configured for integral headphones or any off-the-shelf headphones.

Connectors 100, 200 can comprise first and second earpiece supports 140, 240 configured to receive earpieces 410, 420, respectively. Earpiece supports 140, 240 can extend from the proximal end of tubular members 105, 205 and can comprise a concave shape such that earpieces 410, 420 rest in earpiece supports 140, 240. If cord management device 10 is used with off-the-shelf headphones, it may be desirable to secure earpieces 410, 420 in earpiece supports 140, 240, for example with an adhesive such as glue, a plastic weld, or the like. Alternatively, earpiece supports 140, 240 can be configured such that earpieces 410, 420 are mechanically secured to earpiece supports 140, 240, for example via a snap-fit, clip-in, press-fit, or the like.

Referring specifically to FIGS. 3B and 4B, respectively, tubular members 105, 205 inner diameter (lumens 110, 120 diameter) can range from approximately 0.25 mm to 8 mm, for example approximately 1 mm. In the illustrated embodiment, lumens 110, 120 diameter is larger at the proximal portion as compared to the distal portion. For example, many off-the-shelf headphones include a support structure, not shown, extending from the earpiece having a larger diameter than the cord such as a plastic structure extending from the earpiece. Therefore, lumen 110, 120 diameter can be larger at the proximal portion to house the support structure and smaller at the distal portion to house cord 430. In some embodiments, lumens 110, 120 diameter can be relatively constant from the distal end to the proximal end, for example when cord management device 10 is integral to headphones 400. It is envisioned that the diameter can vary from the proximal end to the distal end to accommodate various headphone components, either off-the-shelf or integral headphones.

First connecting member 150 is configured to connect to second connector 250 creating connection point 260. Connecting members 150, 250 can connect via a mechanical connection. In some embodiments, connecting member 150 comprises a male connector and connecting member 250 comprises a female connector, where tactile and/or audible feedback is provided to the user upon connection. In the illustrated embodiments, a protrusion of connecting member 150 is configured to slide into a groove of connecting member 250, providing tactile and audible feedback to the user upon connection. Other mechanical connections can include but are not limited to hook and loop, screw, tongue and groove, pin and hole, snap-fit, and the like. In some embodiments, connecting members 150, 250 can connect via a magnetic connection.

Connecting members 150, 250 can be integral to tubular members 105, 205, respectively, or connecting members 150, 250 can be a separate component attachable to tubular members 105, 205. In the illustrated embodiment, connecting members 150, 250 are positioned at approximately a midpoint of tubular members 105, 205, respectively, however connecting members 150, 250 can be positioned at any point along tubular members 105, 205, respectively. For example, the position of connecting members 150, 250 can be such that cord 430 remains wrapped around connection point 260.

In embodiments where cord management device 10 is used with off-the-shelf headphones, first and second tubular members 105, 205 can comprise slit 120 and slit 220, respectively. Slits 120, 220 enable a user to insert first and second cord portions 431, 432 into lumens 110, 120 of first and second tubular members 105, 205, respectively. Alternatively, first and second tubular members 105, 205 can comprise a two or more-piece design or a hinged design (not shown) to enable a user to insert first and second cord portions 431, 432, respectively.

FIG. 5A is a side view of a third connector; FIG. 5B is a top view of the connector of FIG. 5A; and FIG. 5C is a top view of an alternate third connector. Third connector 300 comprises first opening 310 and second opening 320. As shown, in FIGS. 5A and 5B, first opening 310 is configured to attach to a distal portion of cord 430, for example third cord portion 433, or plug 440. Second opening 320 is configured to attach to any portion of cord 430 after cord 430 is wrapped around connection point 260 such that cord 430 remains in a wrapped configuration. In the embodiment of FIGS. 5A and 5B, opening 310 is partially enclosed such that connector 300 can be used with off-the-shelf headphones. However, when cord management device 10 is integral to headphones 400, opening 310 can be fully enclosed around cord 430 or plug 440, shown as opening 310' in FIG. 5C. First opening 310, 310' should be sized to fit cord 430 or plug 440, and second opening 320 should be sized to fit cord 430 such that cord 430 remains in a wrapped configuration when connector 300 is in use. For example, when opening 310, 310' is configured to be connected to plug 440, and opening 320 is configured to be connected to cord 430, opening 310, 310' will comprise a larger diameter than opening 320.

In the illustrated embodiments, opening 310, 310' is positioned approximately 180 degrees from opening 320, however openings 310, 310', 320 can be positioned anywhere on third connector 300. Third connector 300 can be configured to slide along cord 430 such that the user can select the position of third connector 300.

In the illustrated embodiment, connector 300 comprises a circular cross-sectional shape, however connector 300 can comprise any cross-sectional shape including but not limited to elliptical, triangular, rectangular, or square.

FIG. 6 is a schematic of a system for managing headphone cords, with a pair of headphones in an unwrapped configuration. The system includes headphones 400 and cord management device 10. Headphones 400 comprise first earpiece 410, second earpiece 420, cord 430, and plug 440, e.g. input to an electronic device, positioned at the distal end of cord 430. Cord 430 comprises third cord portion 433, and cord 430 splits into first cord portion 431 and second cord portion 432, resulting in a "Y" configuration. Cord management device 10 comprises first connector 100 and second connector 200. First connector 100 comprises first tubular member 105 having a lumen configured to house a portion of first cord portion 431, and similarly, second connector 200 comprises second tubular member 205 having a lumen configured to house a portion of second cord portion 432. First connector 100 is configured to connect to second connector 200 via first and second connecting members 150, 250 creating connection point 260'.

Cord management device 10 can further comprise third connector 300 comprising a first opening configured to connect to a distal end of cord 430, for example third cord portion 433, or plug 440 and a second opening configured to connect to a portion of cord 430, openings shown in FIG. 5A-C herein.

First connecting member 150 is configured to connect to second connector 250 creating connection point 260'. In the illustrated embodiment, connecting members 150, 250 are positioned at proximal portions of tubular members 105, 205, respectively. Also in this embodiment, connector 100 comprises surface 151, and connector 200 comprises surface 251. Surface 151 can extend from connecting member 150, for example surface 151 is shown extending from connecting member 150 to the proximal end of tubular member 105, i.e. extending upward from connecting member 150. Surface 251 can extend from connecting member 250, for example surface 251 is shown extending from connecting member 250 towards a midportion of tubular member 205, i.e. extending downward from connecting member 250. When connector 100 is connected to connector 200, surfaces 151, 152 increase the surface area of connection point 260' configured to accommodate various headphones components, either integral headphones or off-the-shelf headphones. For example, if headphones comprise control 450, for example a volume or microphone control positioned along cord 430, larger connection point 260' allows the control and cord to wrap around connection point in an orderly manner.

Similar to the embodiments described above, connecting members 150, 250 can connect via a mechanical connection. In some embodiments, connecting member 150 comprises a male connector and connecting member 250 comprises a female connector, where tactile and/or audible feedback is provided to the user upon connection. In the illustrated embodiment, a protrusion of connecting member 150 is configured to slide into a groove of connecting member 250, providing tactile and audible feedback to the user upon connection. Other mechanical connections can include but are not limited to hook and loop, screw, tongue and groove, pin and hole, snap-fit, and the like. In some embodiments, connecting members 150, 250 can connect via a magnetic connection.

Similar to the embodiments described above, tubular members 105, 205 can comprise any cross-sectional shape, including but not limited to circular, elliptical, triangular, rectangular, or square. Tubular members 105, 205 can comprise a length ranging from approximately 10 mm to 60 mm, for example approximately 38 mm. The length of tubular members 105, 205 can be sized to provide adequate support and space for cord 430 when headphones 400, either integral headphones or off-the-shelf headphones, are in a wrapped configuration. Tubular members 105, 205 can comprise an outer diameter ranging from approximately 1 mm to 10 mm, for example approximately 4 mm. Tubular members 105, 205 can comprise a thickness ranging from approximately 0.25 mm to 4 mm, for example approximately 1 mm. Any dimensions provided herein are exemplary only, and should not be construed as limiting. For example, cord management device 10 can be configured for integral headphones or any off-the-shelf headphones.

Similar to the embodiments of FIGS. 3B and 4B, tubular members 105, 205 inner diameter (lumens 110, 120 diameter) can range from approximately 0.25 mm to 8 mm, for example approximately 1 mm. In some embodiments, lumens 110, 120 diameter is larger at the proximal portion as compared to the distal portion. For example, many off-the-shelf headphones include a support structure, not shown, extending from the earpiece having a larger diameter than the cord such as a plastic structure extending from the earpiece. Accordingly, lumen 110, 120 diameter can be larger at the proximal portion to house the support structure and smaller at the distal portion to house cord 430. Alternatively, lumens 110, 120 diameter can remain relatively constant from the proximal end to the distal end of tubular members 105, 205. In embodiments where cord management device 10 is used with off-the-shelf headphones, first and second tubular members 105, 205 can comprise a slit, slits also described in FIGS. 3B and 4B herein.

Cord management device 10 described in FIG. 6 can be used with any headphones, integral headphones or off-the-shelf headphones.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims. In addition, where this application has listed the steps of a method or procedure in a specific order, it may be possible, or even expedient in certain circumstances, to change the order in which some steps are performed, and it is intended that the particular steps of the method or procedure claim set forth here below not be construed as being order-specific unless such order specificity is expressly stated in the claim.

I claim:

1. A headphone cord management device, comprising:

a first connector comprising a first tubular member and a first connecting member;

a second connector comprising a second tubular member and a second connecting member, wherein the first connecting member is configured to connect to the second connecting member to create a connection point, wherein the first and second tubular members comprise a relatively bowed configuration, and wherein the first and second connecting members are positioned at an approximate midpoint of the respective first and second tubular members.

2. The device of claim 1, wherein the first and second connectors are integral to a pair of headphones or the first and second connectors are used with a pair of off-the-shelf headphones.

3. The device of claim 1, wherein the first and second connectors create a relatively "X" shaped configuration when connected.

4. The device of claim 1, wherein the first and/or second tubular member comprises a length ranging from 10 mm to 60 mm and/or an outer diameter ranging from 1 mm to 10 mm and/or an inner diameter ranging, from 0.25 mm to 8 mm and/or a thickness ranging from 0.25 mm to 4 mm.

5. The device of claim 1, wherein the first and/or second tubular member comprises a slit from a distal end to a proximal end.

6. The device of claim 1, wherein the first and/or second connector further comprises a support configured to receive a headphone earpiece.

7. The device of claim 1, wherein the first tubular member comprises a first lumen, and the second tubular member comprises a second lumen.

8. The device of claim 7, wherein the first and/or second lumen comprises a relatively constant diameter from a proximal end to a distal end.

9. The device of claim 7, wherein the first and/or second lumen comprises a diameter that is larger at a proximal portion as compared to a distal portion.

10. The device of claim 1, wherein the first and/or second connecting member is integral to a respective first and/or second tubular member.

11. The device of claim 1, wherein the first connecting member is configured to connect to the second connecting member via a mechanical connection.

12. The device of claim 11, wherein the first connecting member is configured to provide a tactile and/or an audible feedback upon connection to the second connecting member.

13. The device of claim 11, wherein the first connecting member comprises a protrusion, and the second connecting member comprises a groove, wherein the protrusion is configured to slide into the groove.

14. The device of claim 11, wherein the mechanical connection is at least one of a male/female connector; a hook and loop; a screw; a tongue and groove; a pin and hole; or a snap-fit.

15. The device of claim 1, wherein the first connector comprises a first surface, and the second connector comprises a second surface, wherein the first surface and the second surface are configured to increase the surface area of the connection point.

16. The device of claim 1, further comprising a third connector comprising a first opening configured to connect to a distal end of a cord or a plug and a second opening configured to connect to a portion of the cord.

17. The device of claim 16, wherein the third connector is integral to a pair of headphones or used with a pair of off-the-shelf headphones.

18. A cord management device comprising:

a means for housing a portion of a first cord portion;

a means for housing a portion of a second cord portion;

a means to connect the housed cord portions;

a means to support a wrapped cord; and a means to connect a distal end of a cord or a plug to a portion of the cord, wherein the means for housing the first and second portions of the first and second cord portions comprise a relatively bowed configuration, and wherein the means for connecting the housed cord portions are positioned at an approximate midpoint of the means for housing the first and second portions of the first and second cord portions.

* * * * *